US009494029B2

(12) United States Patent
Hughes et al.

(10) Patent No.: US 9,494,029 B2
(45) Date of Patent: Nov. 15, 2016

(54) FORWARD DEPLOYED SENSING ARRAY FOR AN ELECTRIC SUBMERSIBLE PUMP

(71) Applicant: GE Oil & Gas ESP, Inc., Oklahoma City, OK (US)

(72) Inventors: Michael Franklin Hughes, Oklahoma City, OK (US); Scott Mordin Hoyte, Oklahoma City, OK (US)

(73) Assignee: GE Oil & Gas ESP, Inc., Oklahoma City, OK (US)

( * ) Notice: Subject to any disclaimer, the term of this patent is extended or adjusted under 35 U.S.C. 154(b) by 307 days.

(21) Appl. No.: 13/946,374

(22) Filed: Jul. 19, 2013

(65) Prior Publication Data

US 2015/0021014 A1 Jan. 22, 2015

(51) Int. Cl.

| | |
|---|---|
| ***E21B 47/00*** | (2012.01) |
| ***E21B 43/12*** | (2006.01) |
| ***F04D 13/10*** | (2006.01) |
| ***E21B 47/01*** | (2012.01) |
| *E21B 23/00* | (2006.01) |

(52) U.S. Cl.

CPC ..... *E21B 47/00* (2013.01); *E21B 43/128* (2013.01); *E21B 47/0007* (2013.01); *E21B 47/01* (2013.01); *F04D 13/10* (2013.01); *E21B 2023/008* (2013.01)

(58) Field of Classification Search

CPC ..... E21B 2023/008; E21B 43/128; E21B 47/0007; E21B 47/0008; E21B 47/00; E21B 47/01; F04D 13/10

See application file for complete search history.

(56) References Cited

U.S. PATENT DOCUMENTS

| | | | |
|---|---|---|---|
| 6,257,332 | B1 | 7/2001 | Vidrine |
| 6,557,642 | B2 | 5/2003 | Head |
| 6,761,233 | B1 | 7/2004 | Aadland |
| 6,779,598 | B2 | 8/2004 | Hall |
| 7,143,843 | B2 | 12/2006 | Doering |
| 7,325,606 | B1 | 2/2008 | Vail, III |
| 8,770,271 | B2 | 7/2014 | Fielder |
| 8,844,636 | B2 | 9/2014 | Bebak |
| 9,062,503 | B2 | 6/2015 | Lehr |
| 9,133,673 | B2 | 9/2015 | Hill |

(Continued)

FOREIGN PATENT DOCUMENTS

EP 2042683 A1 4/2009

OTHER PUBLICATIONS

International Search Report and Written Opinion issued in connection with corresponding PCT Application No. PCT/US2014/047017 dated May 8, 2015.

*Primary Examiner* — Robert E Fuller
*Assistant Examiner* — Christopher Sebesta
(74) *Attorney, Agent, or Firm* — Crowe & Dunlevy, P.C.

(57) ABSTRACT

An electric submersible pumping system has an electric motor, a pump assembly driven by the electric motor and a sensor module. The sensor module preferably includes a detachable sensor array that can be selectively released from the sensor module. In preferred embodiments, the detachable sensor array includes a self-propelled sensor array vehicle that has a drive motor, a drive mechanism driven by the drive motor and a sensor array. The detachable sensor array provides a wellbore condition signal that can be used to automatically adjust the performance of the electric submersible pumping system.

21 Claims, 4 Drawing Sheets

(56) References Cited

U.S. PATENT DOCUMENTS

| | | | | |
|---|---|---|---|---|
| 2003/0112150 | A1 | 6/2003 | Schrenkel et al. | |
| 2004/0055746 | A1 | 3/2004 | Ross et al. | |
| 2004/0108110 | A1 | 6/2004 | Zupanick | |
| 2005/0217861 | A1 | 10/2005 | Misselbrook | |
| 2006/0042835 | A1 | 3/2006 | Guerrero | |
| 2009/0084543 | A1* | 4/2009 | Fitzgerald | 166/250.01 |
| 2009/0271117 | A1* | 10/2009 | Ayoub et al. | 702/11 |
| 2009/0277628 | A1* | 11/2009 | Watson et al. | 166/250.01 |
| 2010/0139388 | A1* | 6/2010 | Griffiths et al. | 73/152.51 |
| 2010/0263856 | A1* | 10/2010 | Lynde et al. | 166/53 |
| 2010/0314103 | A1* | 12/2010 | Crossley et al. | 166/250.01 |
| 2011/0051297 | A1* | 3/2011 | Knox et al. | 361/23 |
| 2012/0012333 | A1 | 1/2012 | Quigley | |
| 2012/0145380 | A1 | 6/2012 | Draper et al. | |
| 2013/0025852 | A1* | 1/2013 | Edmonstone et al. | 166/250.01 |
| 2013/0129543 | A1* | 5/2013 | McKinney | F04B 47/02 417/423.3 |
| 2013/0333970 | A1 | 12/2013 | Heieie | |
| 2014/0341755 | A1 | 11/2014 | Laing | |

* cited by examiner

FORWARD DEPLOYED SENSING ARRAY FOR AN ELECTRIC SUBMERSIBLE PUMP

FIELD OF THE INVENTION

This invention relates generally to the field of downhole pumping systems, and more particularly to sensing arrays optimized for use in deviated wellbores.

BACKGROUND

Submersible pumping systems are often deployed into wells to recover petroleum fluids from subterranean reservoirs. Typically, a submersible pumping system includes a number of components, including an electric motor coupled to one or more pump assemblies. Production tubing is connected to the pump assemblies to deliver the wellbore fluids from the subterranean reservoir to a storage facility on the surface.

With advancements in drilling technology, it is now possible to accurately drill wells with multiple horizontal deviations. Horizontal wells are particularly prevalent in unconventional shale plays, where vertical depths may range up to about 10,000 feet with lateral sections extending up to 8,000 feet. In these highly deviated wells, it can be difficult or impossible to fully deploy a conventional electric submersible pump (ESP). The ESP is typically installed in the vertical section of the well at some distance from the lateral sections.

The current deployment of ESPs in deviated wells has not been highly successful. Often, large slugs of gas accumulate in the lateral sections of the well and then move into the ESP. The large pockets of gas can cause the ESP to stop producing and possibly overheat. Past attempts at addressing the gas slugging problem have not produced desirable results. There is therefore a continued need for an improved ESP design that is more resistant to gas slugging problems experienced in a deviated wellbore. It is to these and other deficiencies in the prior art that the present invention is directed.

SUMMARY OF THE INVENTION

In a preferred embodiment, the present invention includes an electric submersible pumping system that has an electric motor, a pump assembly driven by the electric motor and a sensor module. The sensor module preferably includes a detachable sensor array that can be selectively released from the sensor module. In preferred embodiments, the detachable sensor array includes a self-propelled sensor array vehicle that has a drive motor, a drive mechanism driven by the drive motor and a sensor array.

In another aspect, the presently preferred embodiments include a method for optimizing the performance of an electric submersible pumping system. The method includes the steps connecting a sensor module within the electric submersible pumping system and installing the electric submersible pumping system into a wellbore. The method continues by deploying a detachable sensor array into the wellbore from the sensor module and measuring a wellbore condition with the detachable sensor array. Lastly, the method includes a step of outputting a wellbore condition signal from the detachable sensor array. The wellbore condition signal can be used to automatically adjust the performance of the electric submersible pumping system and to provide a forecasted prediction of changes in environmental conditions approaching the electric submersible pumping system.

DETAILED DESCRIPTION OF THE PREFERRED EMBODIMENT

As used herein, the term "petroleum" refers broadly to all mineral hydrocarbons, such as crude oil, gas and combinations of oil and gas. Furthermore, as used herein, the term "two-phase" refers to a fluid that includes a mixture of gases and liquids. It will be appreciated by those of skill in the art that, in the downhole environment, a two-phase fluid may also carry solids and suspensions. Accordingly, as used herein, the term "two-phase" not exclusive of fluids that contain liquids, gases, solids, or other intermediary forms of matter.

Figure 1:
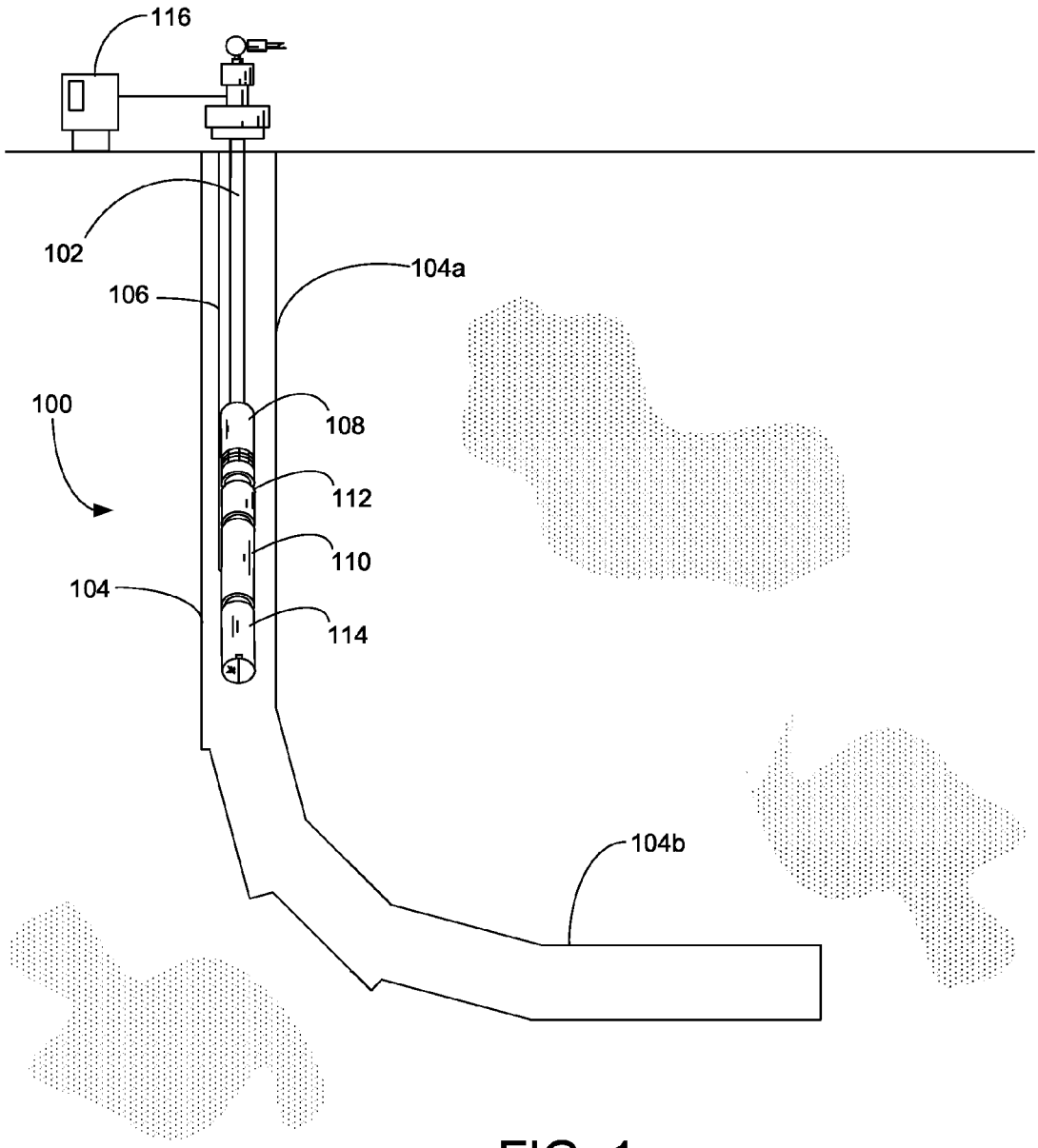
FIG. 1 is a side elevational view of an electric submersible pumping system constructed in accordance with a preferred embodiment.

In accordance with a preferred embodiment of the present invention, FIG. 1 shows an elevational view of a submersible pumping system 100 attached to production tubing 102. The pumping system 100 and production tubing 102 are disposed in a wellbore 104, which is drilled for the production of a fluid such as water or petroleum. The wellbore 104 includes a vertical section 104*a* and a lateral section 104*b*. The production tubing 102 connects the pumping system 100 to surface facilities. Although the pumping system 100 is primarily designed to pump petroleum products, it will be understood that the present invention can also be used to move other fluids. It will be further understood that the depiction of the wellbore 104 is illustrative only and the presently preferred embodiments will find utility in wellbores of varying depths and configurations.

The pumping system 100 preferably includes some combination of a power cable 106, a pump assembly 108, a motor assembly 110, a seal section 112 and a sensor array housing 114. The pump assembly 108 is preferably configured as a multistage centrifugal pump that is driven by the motor assembly 110. The motor assembly 110 is preferably configured as a three-phase electric motor that rotates an output shaft in response to the application of electric current at a selected frequency. In a particularly preferred embodiment, the motor assembly 110 is driven by a variable speed drive 116 positioned on the surface. Power is conveyed from the variable speed drive 116 to the motor assembly 110 through the power cable 106.

The seal section 112 shields the motor assembly 110 from mechanical thrust produced by the pump assembly 108 and provides for the expansion of motor lubricants during operation. Although only one of each component is shown, it will be understood that more can be connected when appropriate.

For example, in many applications, it is desirable to use tandem-motor combinations, multiple seal sections and multiple pump assemblies. It will be further understood that the pumping system 100 may include additional components, such as shrouds and gas separators, not necessary for the present description.

For the purposes of the disclosure herein, the terms "upstream" and "downstream" shall be used to refer to the relative positions of components or portions of components with respect to the general flow of fluids produced from the wellbore 104. "Upstream" refers to a position or component that is passed earlier than a "downstream" position or component as fluid is produced from the wellbore 104. The terms "upstream" and "downstream" are not necessarily dependent on the relative vertical orientation of a component or position. It will be appreciated that many of the components in the pumping system 100 are substantially cylindrical and have a common longitudinal axis that extends through the center of the elongated cylinder and a radius extending from the longitudinal axis to an outer circumference. Objects and motion may be described in terms of radial positions within discrete components in the pumping system 100.

Although the preferred embodiments are described with reference to electric submersible pumping systems, it will be appreciated that the preferred embodiments and variations thereof may find utility in other production systems, including, but not limited to, surface-based centrifugal and positive displacement pumping systems. The sensor module 114 can be deployed in a variety of applications to provide downstream equipment with forecasted projections of changing wellbore conditions.

Figure 2:
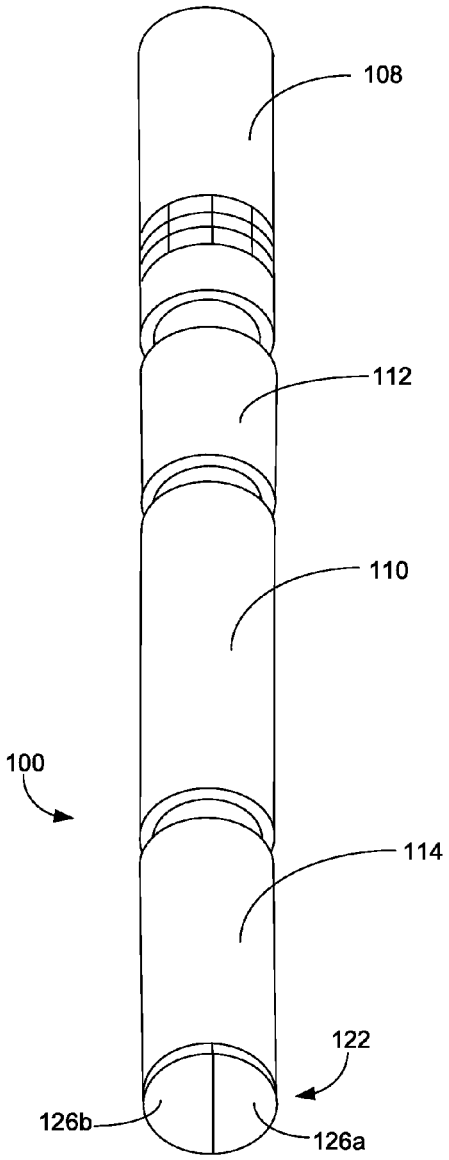
FIG. 2 is a perspective view of the electric submersible pumping system of FIG. 1.
Figure 3:
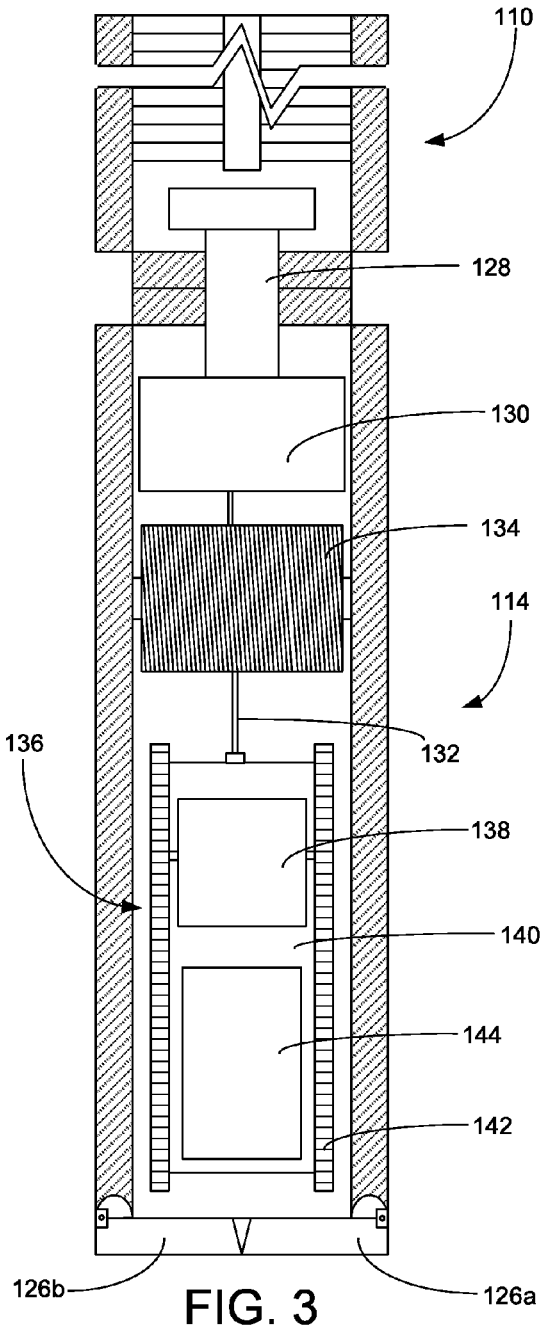
FIG. 3 is a partial cross-sectional view of the sensor housing and motor of the electric submersible pumping system of FIG. 2.

Turning now to FIGS. 2 and 3, shown therein are a close-up perspective view of the pumping system 100 and a partial cross-sectional view of the sensor module 114, respectively. The sensor module 114 includes a proximal end 118 connected to the motor assembly 110 and a distal end 120 positioned at the terminal end of the pumping system 100. The sensor module 114 includes a motorized hatch 122 at the distal end 120 and an outer housing 124. The motorized hatch 122 can be selectively and controllably operated to open and close. In a presently preferred embodiment, the motorized hatch 122 includes two doors 126*a*, 126*b* that are hinged to the outer housing 124.

The sensor module 114 is connected to the motor assembly 110 and includes a pass-through 128. The pass-through 128 provides a sealed passage for carrying electrical wiring and other conduits from the motor assembly 110 to the sensor module 114. In particularly preferred embodiments, the motor housing 110 is hermetically sealed from the sensor module 114 to prevent contamination of motor lubricants within the motor housing 110.

The sensor module 114 further includes a control board 130, an umbilical 132, an umbilical reel 134 and a sensor array vehicle 136. The control board 130 is configured to provide power to the sensor array vehicle 136 and to process, condition and transmit signals produced by the sensor array vehicle 136. Electrical power and signal transmission are conveyed between the control board 130 and the sensor array vehicle 136 via the umbilical 132. In a particularly preferred embodiment, the umbilical 132 includes one or more electric conductors shielded by a multilayer insulator. Preferred electric insulators may include, for example, polyetheretherketone (PEEK). An external shielded layer may include a wire mesh jacket. The umbilical 132 is preferably stored, deployed and retracted on a powered reel 134. The reel 134 can be selectively operated to deploy or retract the umbilical 132 while measuring the length of the umbilical unwound from the reel 134.

The umbilical 132 is attached to the sensor array vehicle 136. The sensor array vehicle 136 preferably includes an electric motor 138, a chassis 140, a drive mechanism 142, and a sensor array 144. The electric motor 138 converts electricity provided by the umbilical 132 into motion that is transferred to the drive mechanism 142. The drive mechanism 142 selectively moves the sensor array vehicle 136 along the wellbore 104. The sensor array 144 includes a selected sensor package that preferably includes a plurality of sensors. Suitable sensors include temperature sensors, lights, visual sensors, cameras, position sensors, pressure sensors, vibration sensors, gas detection sensors and gas content analyzers.

Each of the sensors is configured to produce a signal representative of a measured condition. The measurement signal is then transmitted through the umbilical 132 to the control board 130. The measurement signal is then transmitted from the sensor module 114 to the motor assembly 110. From the motor assembly 110, the signal is carried to the surface on the motor power cable 106 or on a dedicated data transmission line. Alternatively, the signals output from the sensor array 144 are transmitted wirelessly through the wellbore 104 to the motor assembly 110 or the variable speed drive 116 and other surface facilities.

Figure 4:
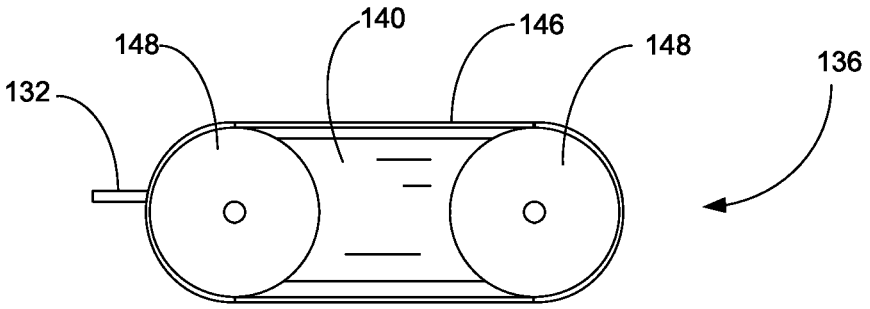
FIG. 4 is a side elevational view of a first preferred embodiment of the sensor array vehicle.
Figure 5:
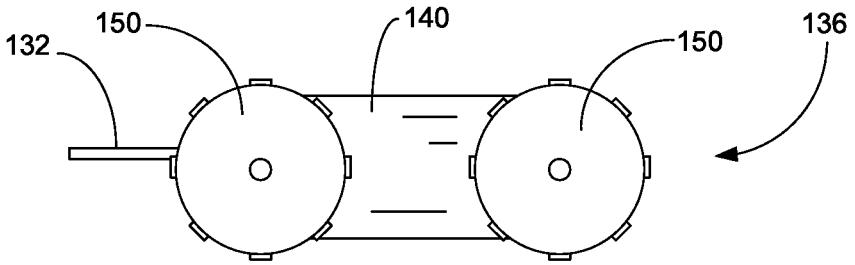
FIG. 5 is a side elevational view of a second preferred embodiment of the sensor array vehicle.
Figure 6:
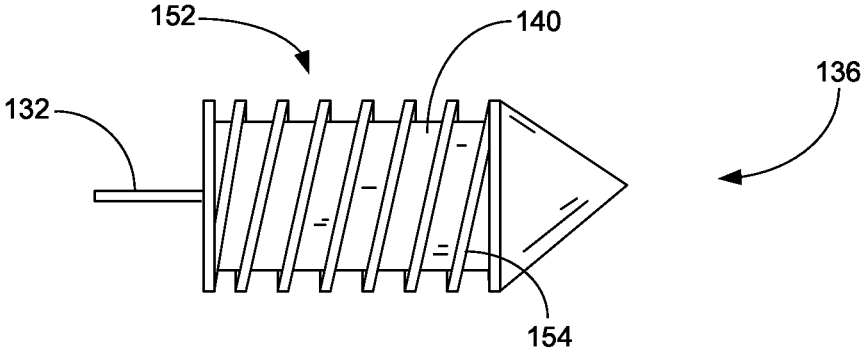
FIG. 6 is a side elevational view of a third preferred embodiment of the sensor array vehicle.

Turning to FIGS. 4-6, shown therein are presently preferred embodiments of the sensor array vehicle 136. In the embodiment depicted in FIG. 4, the drive mechanism 142 includes an endless track 146 that is rotated by conveyor wheels 148. In the embodiment depicted in FIG. 5, the drive mechanism 142 includes a series of geared wheels 150. In the embodiment depicted in FIG. 6, the drive mechanism 142 includes a rotary auger 152 that pulls the sensor array vehicle 136 along the wellbore 104. The rotary auger 152 includes one or more continuous spiraled flights 154. It will be further understood that the drive mechanism 142 can be configured to steer and change the direction of movement of the sensor array vehicle 136.

Figure 7:
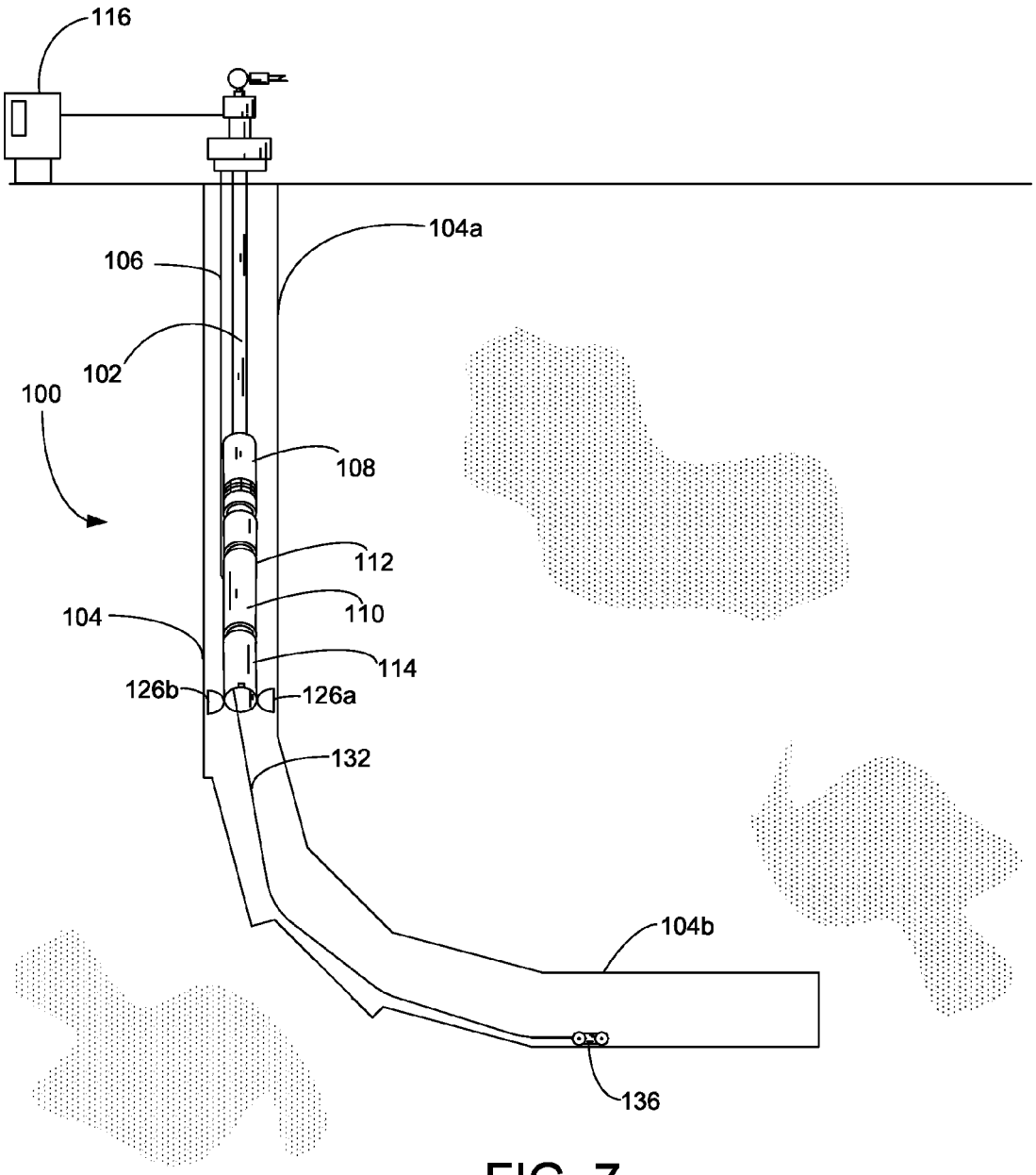
FIG. 7 is a side elevational view of an electric submersible pumping system constructed in accordance with a preferred embodiment showing the sensor array vehicle in a forward deployed position.

Turning now to FIG. 7, shown therein is a preferred embodiment of the pumping system 100 in which the sensor array vehicle 136 has been deployed from the sensor module 114. In a preferred method of operation, the pumping system 100 is deployed to the selected depth within the wellbore vertical section 104*a*. When the pumping system 100 has been positioned at the desired depth, the sensor module 114 deploys the sensor array vehicle 136. In highly preferred embodiments, the deployment of the sensor array vehicle 136 is accomplished by opening the hatch 122 and allowing gravity to pull the sensor array vehicle 136 and umbilical 132 from the sensor module 114.

When the sensor array vehicle 136 contacts the floor of the wellbore 104, the drive mechanism 142 is engaged and the sensor array vehicle 136 is driven to a desired location in the wellbore horizontal section 104*b*. As the sensor array vehicle 136 is deployed and driven, the umbilical is unwound from the storage position on the reel 134.

When the sensor array vehicle 136 has reached its destination, the sensors are used to detect an upstream change in wellbore conditions. The sensor array vehicle 136 thus provides a forecast of changing wellbore conditions to the variable speed drive 116 or other control and monitoring equipment. By providing advance notice of changing conditions downstream from the pumping system 100, the operation of the pumping system 100 can be automatically adjusted to protect the pumping system 100 from harmful conditions. For example, if the sensor array vehicle 136 detects and transmits the presence of a large gas slug, the variable speed drive can immediately respond by reducing the operating frequency of the pumping system 100 to mitigate any damage caused by the large gas slug. In this way, the sensor array vehicle 136 outputs information about wellbore conditions approaching the pumping system 100. The pumping system 100 can take protective, precautionary or optimization efforts in response to the signals produced by the forward-deployed sensor array vehicle 136. The ability to adjust in real-time the operation of the pumping system 100 in response to a forecasted change of conditions represents a significant improvement over the current state of the art that will permit the protection and optimization of the pumping system 100.

The sensor array vehicle 136 can be retrieved one of two ways. In a first preferred embodiment, the sensor array vehicle 136 can be driven under its own power along the horizontal section 104*b* to the kick-out or deviation proximate the vertical section 104*a*. The slack in the umbilical 132 is collected on the retracting reel 134. When the sensor array vehicle 136 reaches the vertical section 104*a*, the umbilical reel 134 continues to retract pulling the sensor array vehicle 136 back into the sensor module 114. The sensor module 114 can then be closed and the entire pumping system 100 pulled to the surface.

Alternatively, the sensor array vehicle 136 can be left in the deployed position outside the sensor module 114 while the pumping system 100 is pulled to the surface. As the pumping system 100 is being pulled up the wellbore 104, the sensor array vehicle 136 is also pulled through the wellbore 104 by the umbilical 132. The sensor array vehicle 136 can then be retrieved at the surface with the other components of the pumping system 100.

It is to be understood that even though numerous characteristics and advantages of various embodiments of the present invention have been set forth in the foregoing description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. An electric submersible pumping system comprising:
- an electric motor;
- a pump assembly driven by the electric motor; and
- a sensor module, wherein the sensor module comprises a detachable sensor array that can be selectively released from the sensor module and wherein the sensor module includes:
  - a pass-through that carries electrical wiring to the motor; and
  - a hatch, wherein the hatch is motorized and includes a pair of doors that can be controllably opened and closed.

2. The electric submersible pumping system of claim 1, wherein the detachable sensor array comprises a sensor array vehicle, wherein the sensor array vehicle comprises:
- a drive motor;
- a drive mechanism driven by the drive motor; and
- a sensor array.

3. The electric submersible pumping system of claim 2, wherein the sensor array includes one or more sensors selected from the group consisting of temperature sensors, visual sensors, cameras, position sensors, pressure sensors, vibration sensors, gas detection sensors and gas content analyzers.

4. The electric submersible pumping system of claim 2, wherein the drive mechanism is selected from the group consisting of wheels, tracks and augers.

5. The electric submersible pumping system of claim 1, wherein the sensor module further comprises:
- a control board; and
- an umbilical connected between the control board and the detachable sensor array.

6. The electric submersible pumping system of claim 5, wherein the umbilical is stored on a powered reel within the sensor module.

7. The electric submersible pumping system of claim 1, wherein the hatch is configured to be selectively opened to permit the deployment of the detachable sensor array.

8. The electric submersible pumping system of claim 1, wherein the detachable sensor array is configured to measure wellbore conditions and output a signal representative of the measured wellbore condition.

9. The electric submersible pumping system of claim 8, further comprising a variable speed drive that controls the operation of the electric motor and wherein the signal representative of the measured wellbore condition is provided to the variable speed drive.

10. A method for optimizing the performance of a pumping system, the method comprising the steps of:
- providing an electric motor to drive the pumping system;
- providing a sensor module that includes a pass-through that carriers electrical wiring to the motor and a motorized hatch that includes a pair of doors that can be controllably opened and closed;
- installing the sensor module into a wellbore;
- opening the motorized hatch;
- deploying a detachable sensor array from the sensor module to a remote location in the wellbore;
- measuring a wellbore condition at the remote location with the detachable sensor array;
- outputting a wellbore condition signal from the detachable sensor array; and
- adjusting an operating parameter of the pumping system in response to the wellbore condition signal.

11. The method of claim 10, wherein the pumping system is an electric submersible pumping system and the method further comprises the step of connecting the sensor module to the electric submersible pumping system and the step of installing the sensor module further comprises installing the electric submersible pumping system and sensor module into a wellbore.

12. The method of claim 11, wherein the step of adjusting an operating parameter further comprises adjusting the operating speed of an electric motor within the electric submersible pumping system in response to the wellbore condition signal.

13. The method of claim 10, wherein the step of deploying a detachable sensor array further comprises releasing a sensor array vehicle into the wellbore.

14. The method of claim 13, wherein the step of deploying a detachable sensor array further comprises:
- dropping the sensor array vehicle onto a surface of the wellbore; and
- driving the sensor array vehicle to a desired measurement point in the wellbore.

15. The method of claim 14, wherein the step of driving the sensor array vehicle to a desired measurement point in the wellbore further comprises energizing a drive motor within the sensor array vehicle to activate a drive mechanism.

16. The method of claim 14, further comprising a step of providing an umbilical between the sensor module and the sensor array vehicle.

17. The method of claim 10, further comprising the step of outputting a wellbore condition signal from the detachable sensor array that provides a forecast prediction of changes in environmental conditions approaching the submersible pumping system.

18. The method of claim 10, further comprising the steps of:

retracting the detachable sensor array into the sensor module; and retrieving the sensor module from the well.

19. A submersible pumping system for use in a deviated wellbore having a vertical section and a lateral section, the pumping system comprising:

a pump assembly positioned in the vertical section;

a motor assembly positioned in the vertical section; wherein the motor assembly has a first end and a second end;

a seal section connected between the pump and the first end of the motor assembly;

a sensor module positioned in the vertical section; wherein the sensor module is connected to the second end of the motor assembly, and wherein the sensor module includes:

a pass-through that carries electrical wiring to the motor assembly; and a hatch, wherein the hatch is motorized and includes a pair of doors that can be controllably opened and closed; and a detached sensor array positioned in the lateral section, wherein the detached sensor array provides a signal representative of a wellbore condition in the lateral section.

20. The submersible pumping system of claim 19, wherein the detached sensor array comprises a self-propelled sensor array vehicle.

21. The submersible pumping system of claim 20, wherein the self-propelled sensor array vehicle is connected to the sensor module by an umbilical.

* * * * *